US011684108B2

(12) United States Patent
Maze

(10) Patent No.: US 11,684,108 B2
(45) Date of Patent: Jun. 27, 2023

(54) SHOE APRON

(71) Applicant: Kristin Gebert Maze, Sonoma, CA (US)

(72) Inventor: Kristin Gebert Maze, Sonoma, CA (US)

( * ) Notice: Subject to any disclaimer, the term of this patent is extended or adjusted under 35 U.S.C. 154(b) by 0 days.

(21) Appl. No.: 17/558,648

(22) Filed: Dec. 22, 2021

(65) Prior Publication Data

US 2022/0354210 A1 Nov. 10, 2022

Related U.S. Application Data

(60) Provisional application No. 63/186,040, filed on May 7, 2021.

(51) Int. Cl.
*A43B 3/20* (2022.01)
*A43B 3/18* (2022.01)

(52) U.S. Cl.
CPC . *A43B 3/20* (2013.01); *A43B 3/18* (2013.01)

(58) Field of Classification Search
CPC ..... A43B 3/20; A43B 3/18
USPC ..... 36/7.2, 7.4, 7.7
See application file for complete search history.

(56) References Cited

U.S. PATENT DOCUMENTS 900,499 A * 10/1908 Eckhard ..... A43B 7/32 36/7.4
1,382,748 A * 6/1921 Slasor ..... A43B 3/20 36/72 R
2,434,331 A * 1/1948 Miller ..... A43B 3/20 36/72 R
2,436,187 A * 2/1948 Bestland ..... A43B 3/20 36/72 R
2,506,245 A * 5/1950 Stanton ..... A43B 3/20 36/7.2
2,657,477 A * 11/1953 Winslow ..... A43B 3/20 D2/913

(Continued)

FOREIGN PATENT DOCUMENTS

GB 2504705 A * 2/2014 ..... A43B 3/20
JP 2002078503 A * 3/2002 ..... A43B 3/20

OTHER PUBLICATIONS

Title: Heel Swaps; Website: https://www.facebook.com/heelswaps; Published: Feb. 14, 2016 (according to Internet Archive (https://web.archive.org/)) (same product as previously cited "High Heel Shoe Covers, https://www.pinterest.es/pin/82120393194579866/").

(Continued)

*Primary Examiner* — Ted Kavanaugh
(74) *Attorney, Agent, or Firm* — Kenyon Jenckes

(57) ABSTRACT

A shoe protection apparatus, or "shoe apron", may include a shoe apron body that covers the top of the wearer's shoe. The shoe apron may be made from a variety of materials, and may be a single layered material or multiple layers of different materials. An arch fastener, such as a band of elastic, may be attached to the shoe apron body at a position approximating the arch of the wearer's shoe. An ankle fastener may be provided at the back of the shoe apron body to further secure the shoe apron to the shoe. A toe piece may be attached to the front of the shoe apron body to provide a sock-like enclosure for the toe of the shoe to further secure the shoe apron body. The toe piece may include a skid-resistance material to provide improved traction.

6 Claims, 7 Drawing Sheets

(56) References Cited

U.S. PATENT DOCUMENTS

| | | | | |
|---|---|---|---|---|
| 5,778,564 | A | 7/1998 | Kettner | |
| 5,845,416 | A | 12/1998 | Hands | |
| 5,987,778 | A * | 11/1999 | Stoner | A43B 7/32 36/109 |
| 2016/0309832 | A1* | 10/2016 | Weaver | A43B 7/12 |
| 2020/0359733 | A1* | 11/2020 | Linas | A43B 3/166 |

OTHER PUBLICATIONS

Cycling Shoe Cover MTB , https://www.aliexpress.com/item/2255800162879871.html?gatewayAdapt=4itemAdapt (website available as of May 19, 2022).

* cited by examiner

SHOE APRON

CROSS-REFERENCE TO RELATED APPLICATIONS

This application claims priority to U.S. Provisional Patent Application No. 63/186,040, filed May 7, 2021 and entitled, "K-Booties Shoe Aprons", the entirety of which is incorporated by reference.

TECHNICAL FIELD

The technical field of the disclosed embodiments relate to shoe protection apparatus.

BACKGROUND

Persons working in professions that involve the frequent use of products including chemicals that may damage fabric or other clothing materials may on occasion spill such products on their clothes and footwear, thereby possibly staining or damaging the clothing item.

One such profession is cosmetology, as a variety of products may be used to treat the hair, nails, and/or skin of a client. For example, hair coloring, perming, straightening, smoothing, washing, cutting, styling all involve the use of a variety of products, many of which include ingredients that may permanently deface and/or damage non-hair surfaces, like fabric or leather.

While working, a cosmetologist may be constantly reaching back and forth between the clients' hair and the service tray for a product filled-bowl, or squeezing contents of a bottle of a product. In close quarters, product splashes from nearby co-workers' work may also present a hazard. As such, there are many opportunities for accidents to happen.

Not only do cosmetologists manage the distractions of said sprays, drips, and splashes in cosmetology activities, they are inundated with the hair clippings from cutting hair, and the dander from combing and brushing the hair, all of which may rain upon and contact their feet, including their bare skin.

SUMMARY

Disclosed are various embodiments of a shoe protection apparatus, or "shoe apron". The shoe apron may include a shoe apron body that covers the top of the wearer's shoe. The shoe apron may be made from a variety of materials, including, for example, fabric, polyphenylene ether (PPE), leather, synthetic leather, etc. The shoe apron body may be a single layered material or multiple layers of different materials.

An arch fastener, such as a band of elastic, may be attached to the shoe apron body at a position approximating the arch of the wearer's shoe. An ankle fastener may be provided at the back of the shoe apron body to further secure the shoe apron to the shoe. Various types of fasteners may be employed, such as hook and loop fasteners, or strips of material to tie and tighten the shoe apron to the shoe.

A toe piece may be attached to the front of the shoe apron body to provide a sock-like enclosure for the toe of the shoe to further secure the shoe apron body. The toe piece may include a skid-resistance material to provide improved traction. Some considerations in selecting the material and design of the the toe piece is that it should not be so tacky as to cause tripping, or too weighty as to throw off the posture or gait of the wearer.

DETAILED DESCRIPTION

Cosmetologists work with a wide variety of products in, for example, hair coloring, perming, straightening, smoothing, washing, cutting, styling, etc. Many of these products include ingredients which could permanently deface and/or damage non-hair surfaces, like for example, the cosmetologist's shoes.

Cosmetologists may wear aprons to protect their clothes while working to avoid damage from the many drips and sprays and splatters of the likes of hair color, bleaches and oils, and all the various chemicals used to execute the wide variety of the hair beautifying services that they perform. However, their shoes may be even more vulnerable as horizontal surfaces below the work area, vulnerable to the drips and sprays and splatters which may leave ruinous smudges and stains on those favorite, expensive, and/or designer shoes.

Furthermore, sandals or open toed shoes leave the exposed skin of the top of the foot and toes vulnerable to germs and debris from potentially many sources carried by dander and hairs. Also, these skin surfaces are vulnerable to tiny clipped hairs that embed themselves into the bottom of the toes and feet, which can feel like a really bad splinter, and are difficult to resolve.

In fact, in any craft or trade in the arts dealing with materials, people face potential spills and splatters, whether as a cosmetologist, a culinary chef from airborne grease and sauce splatters, a food server from splashes from accidental food and drink spills, a painter from oil paint drips, or a medical workers in a lab or hospital environment. The potential damage from inevitable splatters and debris to good work shoes may be frustrating, since fashionable or not, shoes built to stand in and walk in for long periods of time are hard to replace, and can be expensive. Protecting their longevity by using protection such as a shoe apron makes fashionable and fiscal sense.

Figure 1:
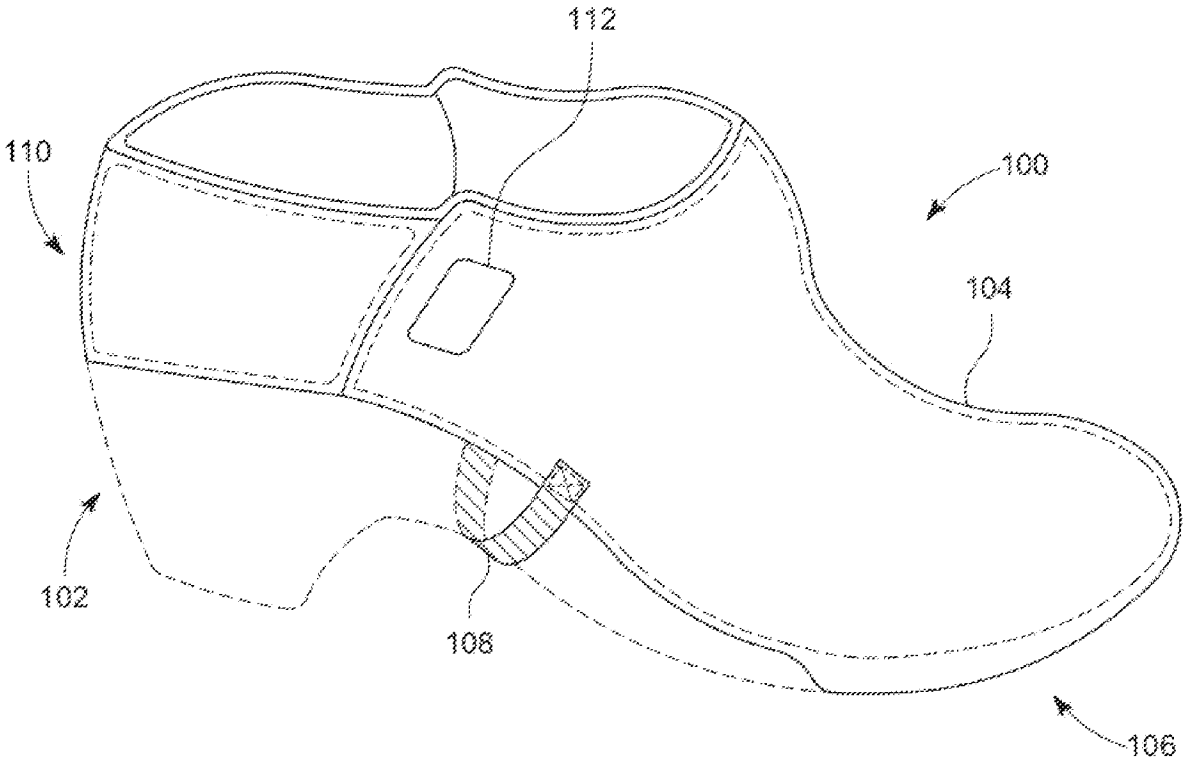
FIG. 1 is a top-oriented perspective view of a shoe apron according to an embodiment.

FIG. 1 shows a pair of shoe aprons 100, according to an embodiment, fitted onto exemplary shoes 102. The shoe aprons may include a shoe apron body 104, a toe piece 106, an arch fastener 108, and an ankle fastener 110.

The shoe apron body 104 may be one or more pieces of fabric and/or other protective material shaped to cover the upper of a particular type of shoe, in this case a low heeled boot-type shoe with a full or open-toed upper. The toe piece 106 may be stitched or otherwise connected to the front of shoe apron body 104 to provide a sock-like toe portion. The toe piece 106 may help secure the shoe apron 100 to the shoe as the fabric of the shoe apron body 104 may slip without it. The material of the toe piece 106 may be made from a skid-resistant material to prevent slipping while moving. Various materials, such as textured fabrics, silicone or rubber with textured or tread patterns may be used.

The arch fastener 108, for example, a band made from an elastic material, may be connected to the shoe apron body 104 at its two ends at a position designed to be behind the toe piece 106 but in front of the heel of the shoe, e.g., approximating the position of the arch of the shoe style. The sole faster 108 further secures the shoe apron 100 to the shoe 102.

The ankle fastener 110 may be a strip of fabric of the same type used in the shoe apron body 104. The ankle fastener 110 may be contiguous with the shoe apron body 104, or may be stitched or otherwise connected to the shoe apron body. One end of the ankle fastener may include a mating portion 112 on its outer surface. This mating portion 112 may be positioned to be secured to a corresponding mating portion 112 on the inner surface of the shoe apron body 104. The mating portions 112 may be a corresponding pair of hook and loop fasteners, e.g., Velcro®. Once the mating portions 112 are connected, the ankle fastener 110 further secures the shoe apron 100 to the shoe 102.

In use, the wearer's shoe may be slid through the top opening of the shoe apron, toes first. Once the shoe is through the arch fastener 108, it is slid into the toe piece 106, as if it were a toe-sock. Once the shoe apron is pulled over the shoe as described above, the end of the arch fastener 110 may be wrapped around the back of the ankle, and the mating portions 112 connected, thereby securing the shoe apron 100 to the shoe 102.

The shoe aprons described may offer different levels of protection, sanitation, and style, have an easy on easy off design, and yet are secure while wearing them. They may serve to hug the wearer's shoe while they work, as well as providing ventilation. Wearing shoe aprons while working also relieves the wearer's subconscious mind of concerns of accidental splashes, etc., hence removing the anxiety of potential disasters from disrupting their creative and time sensitive work.

The materials and designs used for the shoe aprons are preferably attractive, lightweight, and easy for the feet to breathe. Different styles, colors, and patterns may be provided to fit the user's style and mood.

In an embodiment, the materials used for the shoe apron body 104 may be single-layered or multi-layered. For example, the shoe apron body 104 may include a bottom layer made from a breathable, water-resistant material such as polyphenylene ether (PPE). The shoe apron body 104 may also include an upper layer made from a washable/cleanable fabric, lined or unlined, which may be customizable in terms of colors, patterns, logos, etc.

Figure 2:
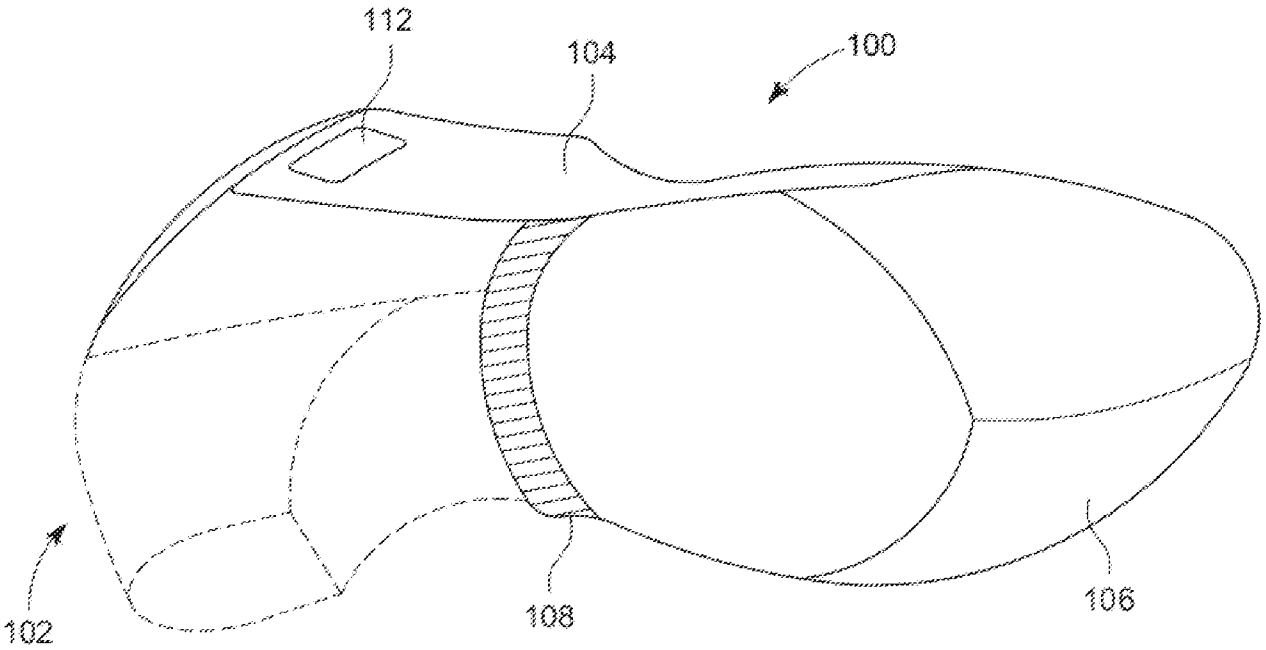
FIG. 2 is a bottom-oriented perspective view of the shoe apron of FIG. 1.
Figure 3:
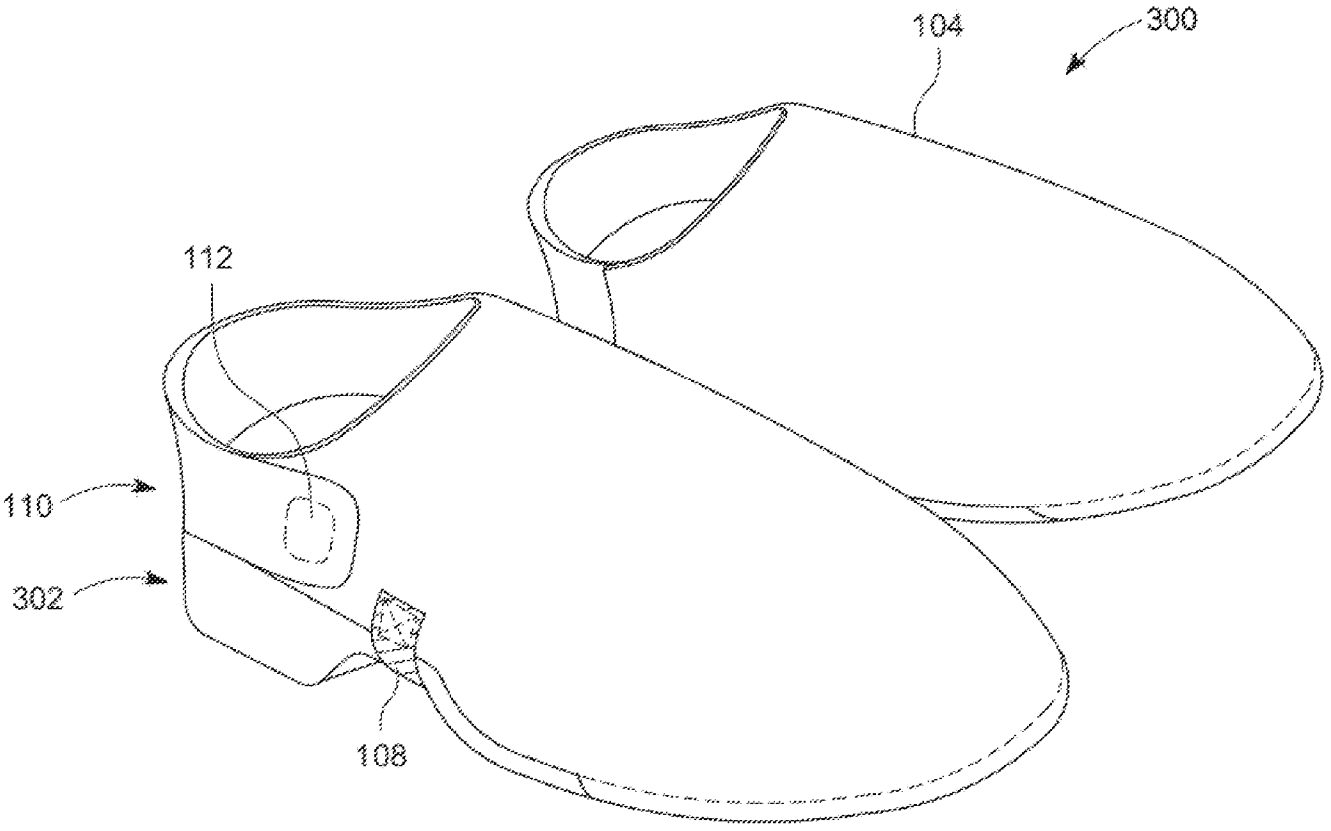
FIG. 3 is perspective view of another embodiment of the shoe apron.

FIG. 3 shows an embodiment of the shoe apron 300 similar to that shown in FIGS. 1 and 2, but shaped for box-toed and sports-style shoes 302, such as tennis shoes or running shoes. In this embodiment, the mating portion 112 on the ankle fastener 110 is on the inner surface of the strip of material, and the mating portion 112 on the shoe apron body 104 is on the outer surface.

Figure 4:
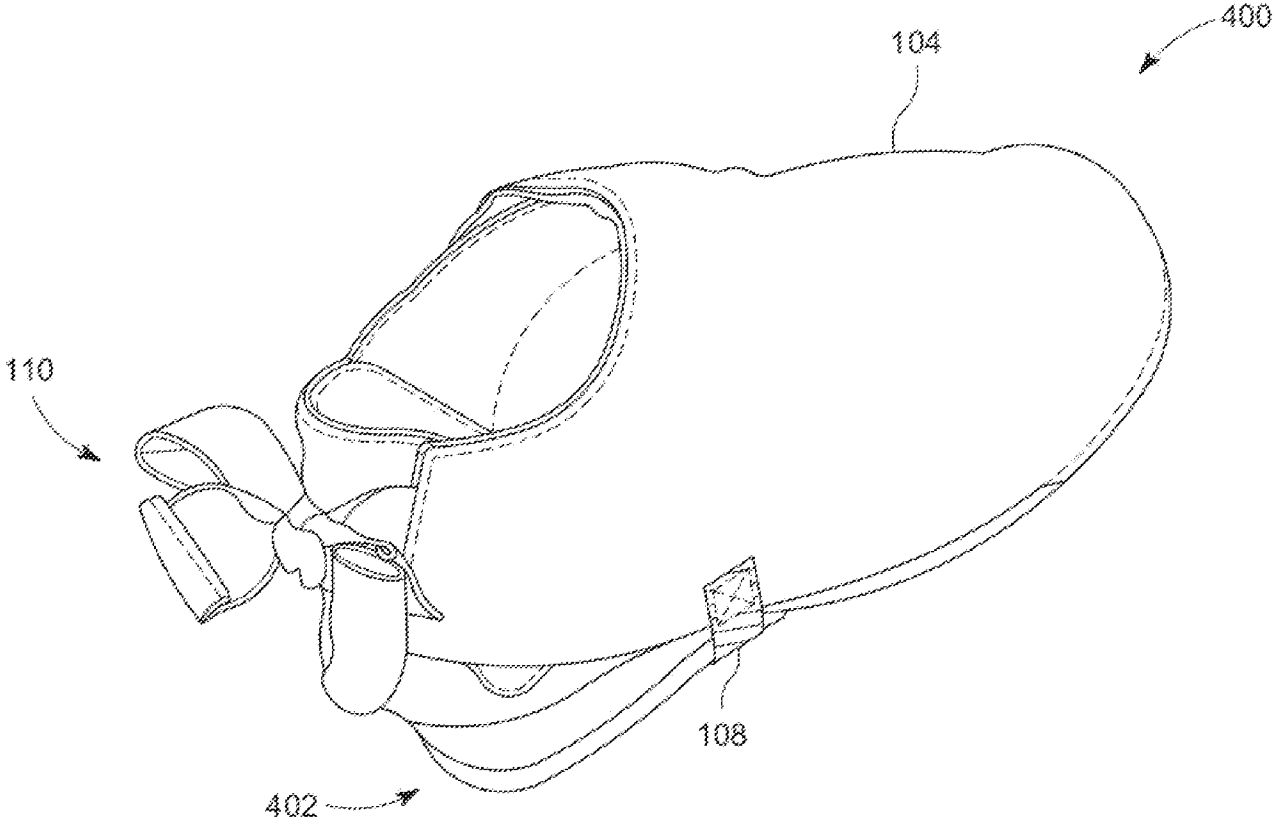
FIG. 4 is a perspective view of an embodiment of the shoe apron with an alternative ankle fastener.

FIG. 4 shows another embodiment of the shoe apron 400 in which the ankle fastener 110 may include two extensions from the rear of the shoe apron body 104 which may be tied to secure the shoe apron to the shoe. Although a wedge-heeled shoe 402 is shown, as with other embodiments, it may be used with other styles of shoes, such as high heeled shoes.

Figure 5:
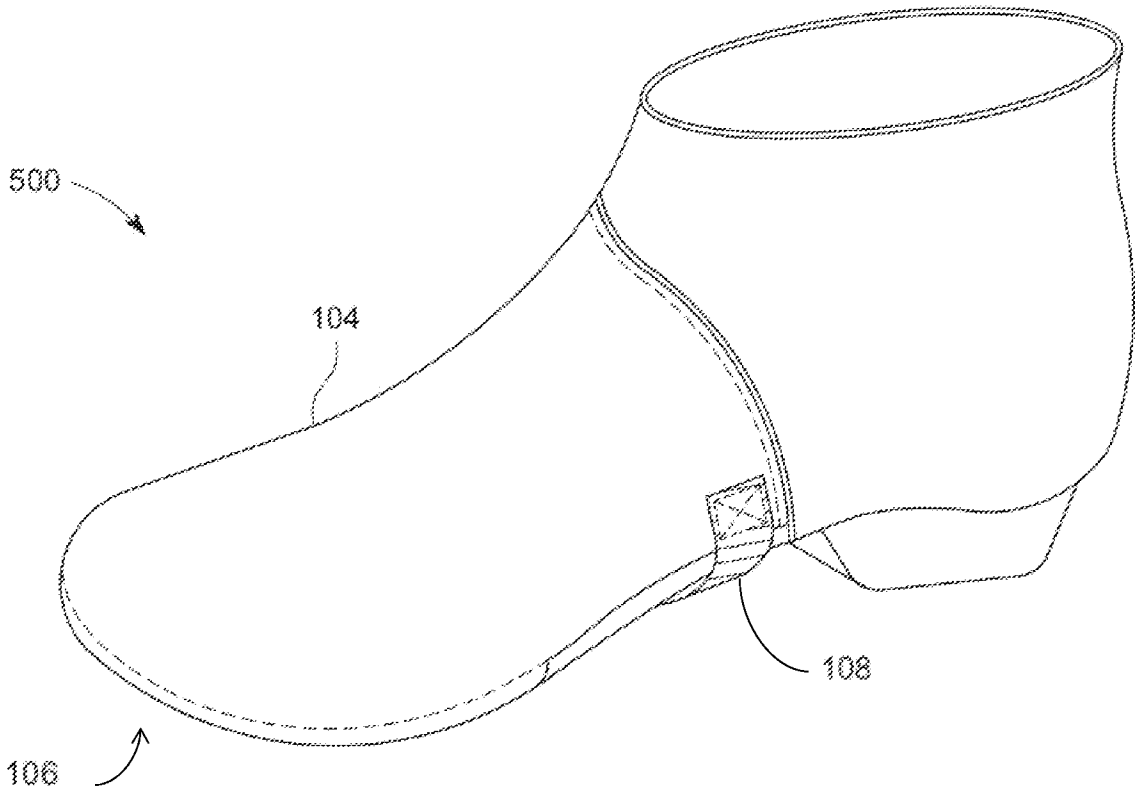
FIG. 5 is a perspective view of an embodiment of the shoe apron without an ankle fastener.

FIG. 5 shows another embodiment of the shoe apron 500 which includes the shoe apron body 104, toe piece 106, and arch fastener 108, but no ankle fastener.

Figure 6:
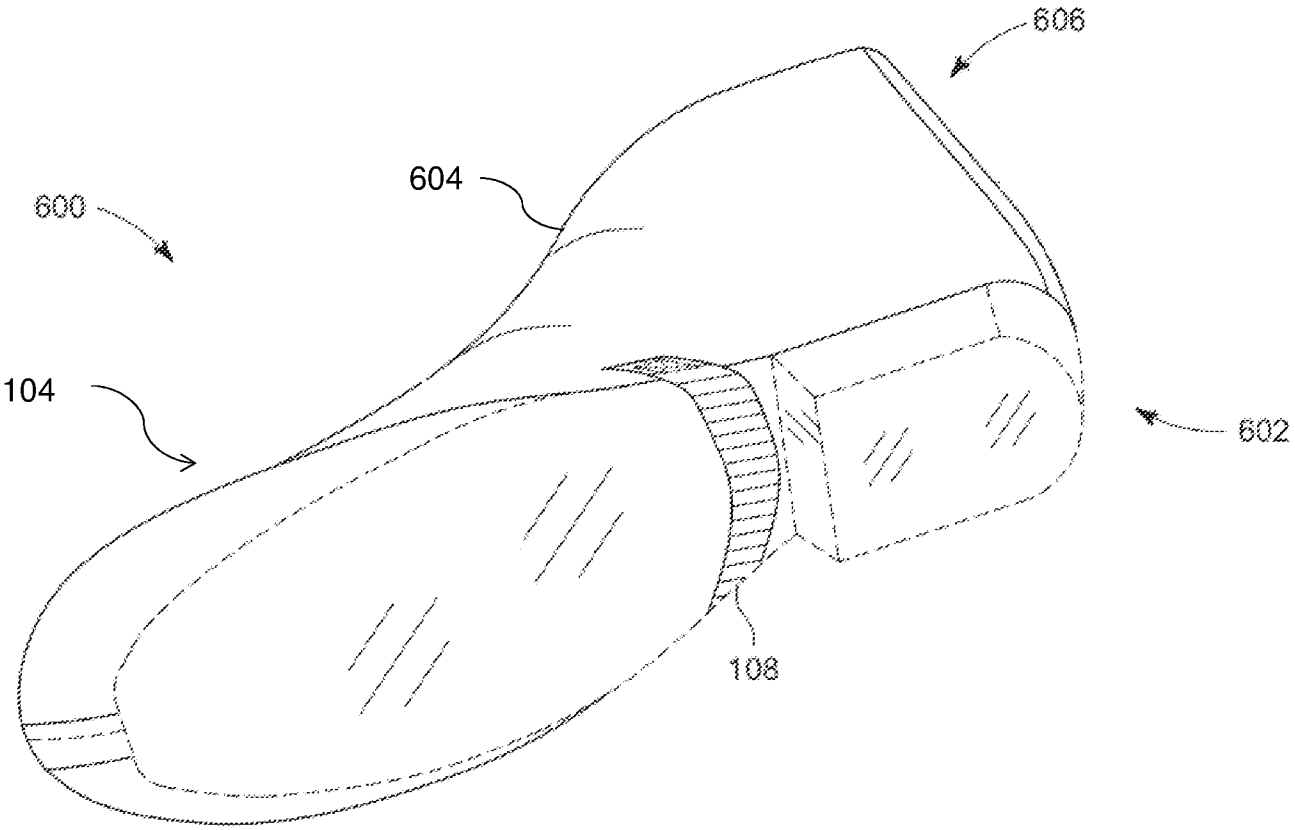
FIG. 6 is a bottom-oriented perspective view of another embodiment of the shoe apron for boot-styled shoes.
Figure 7:
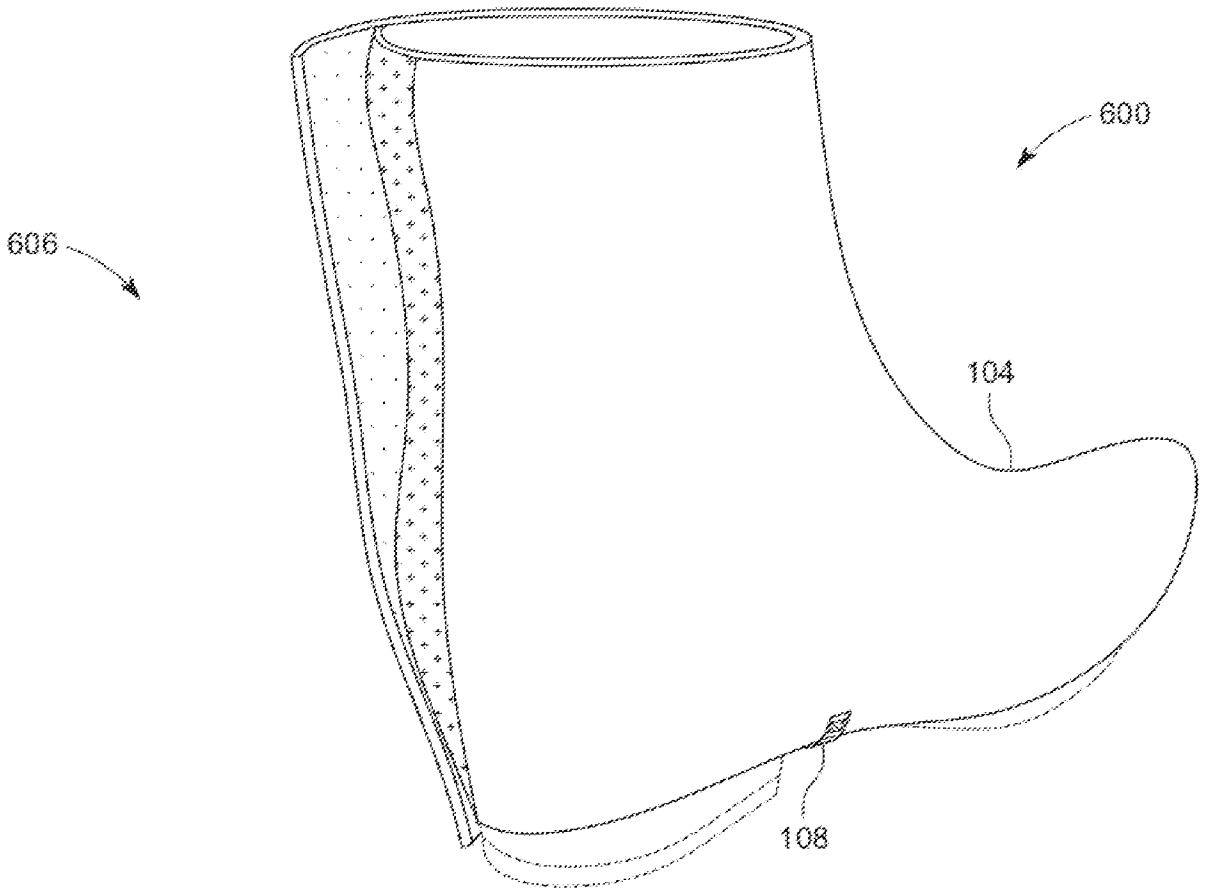
FIG. 7 is side-oriented perspective view of the shoe apron shown in FIG. 6.

FIG. 6 shows another embodiment of the shoe apron 600 for a boot-style shoe 602 with a higher upper 604. The shoe apron 600 may be made from a heavier material, such a leather rather than fabric and/or PPE, and may not require a toe piece 106 as the weight of the shoe apron 600 itself is enough to prevent slippage of the shoe apron body 104 over the top of the shoe. The ankle fastener 110 in this case may be a pair of hook-and-loop fastener strips 606 that extend along the entire rear portion of the shoe apron 600, as shown in FIG. 7.

The above-described embodiments of the present invention are intended to be examples only. Alterations, modifications and variations may be effected to the particular embodiments by those of skill in the art without departing from the scope of the invention, which is defined solely by the claims appended hereto.

The invention claimed is:

1. A shoe protection apparatus comprising:

a shoe apron body having a shape corresponding to an upper front portion of a shoe, the shoe apron body including an outer layer comprising a fabric material, and an inner layer adapted to contact the shoe and comprising a chemical-resistant and water-resistant material;

a toe piece connected along a front edge of the shoe apron body and positioned to cover at least a portion of a front portion a sole of the shoe and expose a portion of the sole corresponding to the metatarsal heads of a user's foot; and an arch fastener having two ends, each end attached to the shoe apron body at a position approximating an arch of said shoe, wherein the apparatus when worn over a shoe has the fabric material of the outer layer visible and covering the inner layer.

2. The shoe protection apparatus of claim 1, wherein a top surface of the fabric material of the outer layer comprises visual pattern.

3. The shoe protection apparatus of claim 1, wherein the inner layer of the shoe apron body comprises at least one layer comprising a polyphenylene ether material.

4. The shoe protection apparatus of claim 1, further comprising:

an ankle fastener connected to the shoe apron body in a position approximating a rear of the shoe.

5. The shoe protection apparatus of claim 4, wherein the ankle fastener comprises at least one strip of material including a hook and loop connector at an end, and wherein the shoe apron body comprises a corresponding hook and loop connector positioned to engage with the hook and loop connector of said strip.

6. The shoe protection apparatus of claim 1, wherein the toe piece comprises a skid-resistance material.

* * * * *